US009896823B2

(12) United States Patent
Lee et al.

(10) Patent No.: US 9,896,823 B2
(45) Date of Patent: Feb. 20, 2018

(54) CAST STEEL FOR CONSTRUCTION EQUIPMENT BUCKET PARTS AND PARTS FOR CONSTRUCTION EQUIPMENT BUCKET COMPRISING THE SAME

(71) Applicant: DOOSAN INFRACORE CO., LTD., Incheon (KR)

(72) Inventors: Choung Rae Lee, Gyeonggi-do (KR); Sang Min An, Gyeonggi-do (KR); Young Ji Shim, Gyeonggi-do (KR); Seok Won Song, Gyeonggi-do (KR); Dong Seob Shim, Gyeonggi-do (KR)

(73) Assignee: Doosan Infracor Co., Ltd., Incheon (KR)

( * ) Notice: Subject to any disclaimer, the term of this patent is extended or adjusted under 35 U.S.C. 154(b) by 473 days.

(21) Appl. No.: 14/483,727

(22) Filed: Sep. 11, 2014

(65) Prior Publication Data

US 2015/0184365 A1 Jul. 2, 2015

(30) Foreign Application Priority Data

Dec. 26, 2013 (KR) ..... 10-2013-0163747

(51) Int. Cl.

| | |
|---|---|
| ***C22C 38/44*** | (2006.01) |
| ***E02F 9/28*** | (2006.01) |
| ***C21D 6/00*** | (2006.01) |
| ***C21D 6/02*** | (2006.01) |
| ***C22C 38/02*** | (2006.01) |
| ***C22C 38/04*** | (2006.01) |
| ***C22C 38/34*** | (2006.01) |
| ***C22C 38/00*** | (2006.01) |
| ***C21D 9/00*** | (2006.01) |

(52) U.S. Cl.

CPC ..... *E02F 9/285* (2013.01); *C21D 6/004* (2013.01); *C21D 6/008* (2013.01); *C21D 6/02* (2013.01); *C21D 9/0068* (2013.01); *C22C 38/002* (2013.01); *C22C 38/02* (2013.01); *C22C 38/04* (2013.01); *C22C 38/34* (2013.01); *C22C 38/44* (2013.01)

(58) Field of Classification Search

CPC ..... E02F 9/285; C22C 38/002; C22C 38/02; C22C 38/04; C22C 38/34; C22C 38/44; C21D 6/004; C21D 6/008; C21D 6/02

See application file for complete search history.

(56) References Cited

U.S. PATENT DOCUMENTS

| | | | | |
|---|---|---|---|---|
| 3,600,160 | A | 8/1971 | Simcoe et al. | |
| 5,714,116 | A * | 2/1998 | Beguinot ..... | C22C 38/54 148/654 |
| 2006/0060270 | A1 | 3/2006 | Klueh et al. | |

FOREIGN PATENT DOCUMENTS

| | | | |
|---|---|---|---|
| CN | 101899551 | A | 12/2010 |
| CN | 102277535 | A | 12/2011 |
| CN | 102367558 | A | 3/2012 |
| CN | 103436808 | A | 12/2013 |
| EP | 1512761 | A1 | 3/2005 |
| JP | 2001152252 | A | 6/2001 |
| KR | 2019990011857 | | 3/1999 |

OTHER PUBLICATIONS

Cai, Changjing, English machine translation of CN 102277535A, Dec. 2011, p. 1-13.*

European Search Report dated Jul. 30, 2015 for European Application No. 14181315.4, 7 pages.

* cited by examiner

*Primary Examiner* — Jessee Roe

(74) *Attorney, Agent, or Firm* — John D. Veldhuis-Kroeze; Westman, Champlin & Koehler, P.A.

(57) ABSTRACT

The present disclosure relates to a cast steel for construction equipment bucket parts and parts for a construction equipment bucket manufactured by using the same, and the cast steel includes 0.27 to 0.34 wt % of carbon (C), 1.2 to 1.8 wt % of chromium (Cr), 0.8 to 1.7 wt % of silicon (Si), 1.0 to 1.4 wt % of manganese (Mn), 0.2 to 0.4 wt % of molybdenum (Mo), 0.2 to 0.4 wt % of nickel (Ni), and a balance of iron and impurities.

12 Claims, 2 Drawing Sheets

CAST STEEL FOR CONSTRUCTION EQUIPMENT BUCKET PARTS AND PARTS FOR CONSTRUCTION EQUIPMENT BUCKET COMPRISING THE SAME

CROSS-REFERENCE TO RELATED APPLICATIONS

This application is based on and claims priority from Korean Patent Application No. 10-2013-0163747, filed on Dec. 26, 2013, with the Korean Intellectual Property Office, the disclosure of which is incorporated herein in its entirety by reference.

FIELD OF THE DISCLOSURE

The present disclosure relates to a cast steel used to manufacture of construction equipment bucket parts.

BACKGROUND OF THE DISCLOSURE

In general, an excavator, which is a kind of construction equipment, is an equipment that moves earth (dirt) for excavating earth and sand or rock, and has a structure in which a front part of a car body thereof includes an arm and a bucket for excavating earth and sand or rock is mounted at an end part of the arm.

The bucket is manufactured of a steel sheet having a high hardness value in order to enhance abrasion resistance. However, since a bucket is manufactured with welding technology, there is a limitation in using a steel sheet having a high hardness value. This reason is because carbon or alloy components need to be put in to enhance the hardness, but weldability deteriorates when the content of the components is high. Accordingly, cast steel parts having a high hardness value, such as a tooth, a shroud or a cutter, are mounted and used in order to reduce damage to the bucket using a coupling method instead of welding. However, these parts also have a limitation in life span due to abrasion.

Meanwhile, in order to enhance weldability and abrasion resistance of a tooth coupled to a bucket, a technology in which tungsten carbide having a high hardness is arc welded has been proposed (see KR20-1999-011857). However, since tungsten carbide having large particle sizes is used in the technology, cracks are generated in an excavation in which impact is high or a work in which base rock is broken, so that there is a problem in that weldability and abrasion resistance deteriorate.

Therefore, there is a need for developing cast steel parts showing high strength and having excellent abrasion resistance and durability in order to enhance the life span of the bucket.

SUMMARY

The present disclosure has been made in an effort to provide a cast steel for construction equipment bucket parts, which shows high strength and has excellent abrasion resistance and durability.

The present disclosure has also been made in an effort to provide parts for a construction equipment bucket, which is manufactured of the cast steel for construction equipment bucket parts.

An exemplary embodiment of the present disclosure provides a cast steel for construction equipment bucket parts, including 0.27 to 0.34 wt % of carbon (C), 1.2 to 1.8 wt % of chromium (Cr), 0.8 to 1.7 wt % of silicon (Si), 1.0 to 1.4 wt % of manganese (Mn), 0.2 to 0.4 wt % of molybdenum (Mo), 0.2 to 0.4 wt % of nickel (Ni), and a balance of iron and impurities, and including MC carbide and at least one carbide selected from $M_7C_3$ carbide, $M_3C_2$ carbide and $M_{23}C_6$ carbide in fa structure thereof, in which the MC carbide is included in an amount of 10 to 65 vol % based on a total 100 vol % of the entire carbide.

The MC carbide may be included in an amount of 15 to 45 vol %.

The MC carbide may be included in crystal particles of the cast steel, and at least one carbide selected from the $M_7C_3$ carbide, the $M_3C_2$ carbide and the $M_{23}C_6$ carbide may be included at a boundary of the crystal particles of the cast steel.

In the cast steel for construction equipment bucket parts of the present disclosure, a total content of the chromium (Cr), silicon (Si) and manganese (Mn) may be 4.1 to 4.9 wt %.

The cast steel for construction equipment bucket parts of the present disclosure may further include 0.01 to 0.03 wt % of vanadium (V).

Another exemplary embodiment of the present disclosure provides a cast steel for construction equipment bucket parts, including 0.27 to 0.34 wt % of carbon (C), 1.2 to 1.8 wt % of chromium (Cr), 0.8 to 1.7 wt % of silicon (Si), 1.0 to 1.4 wt % of manganese (Mn), 0.2 to 0.4 wt % of molybdenum (Mo), 0.2 to 0.4 wt % of nickel (Ni), and a balance of iron and impurities, and including MC carbide and at least one carbide selected from $M_7C_3$ carbide, $M_3C_2$ carbide and $M_{23}C_6$ carbide in a structure thereof, in which when a cut surface after cutting is analyzed by an image analyzer, a ratio (b/a) of an area (b) of the MC carbide to an area (a) of the entire carbides is 0.1 to 0.65 at the cut surface.

Yet another exemplary embodiment of the present disclosure provides a part for a construction equipment bucket obtained by the cast steel for construction equipment bucket parts to post-treatment.

The part for a construction equipment bucket may be a tooth, a tooth adapter, a shroud or a cutter.

According to the exemplary embodiments of the present disclosure, since the cast steel for construction equipment bucket parts of the present disclosure includes carbon, chromium, silicon, manganese, molybdenum and nickel in specific ranges and MC carbide in the structure thereof is included in an amount of 10 to 65 vol % based on the total amount of the entire carbides, the cast steel for construction equipment bucket parts of the present disclosure shows high strength and has excellent abrasion resistance and durability. Therefore, the parts for a construction equipment bucket, which are composed of the cast steel for construction equipment bucket parts of the present disclosure, have a long life span and excellent impact resistance.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
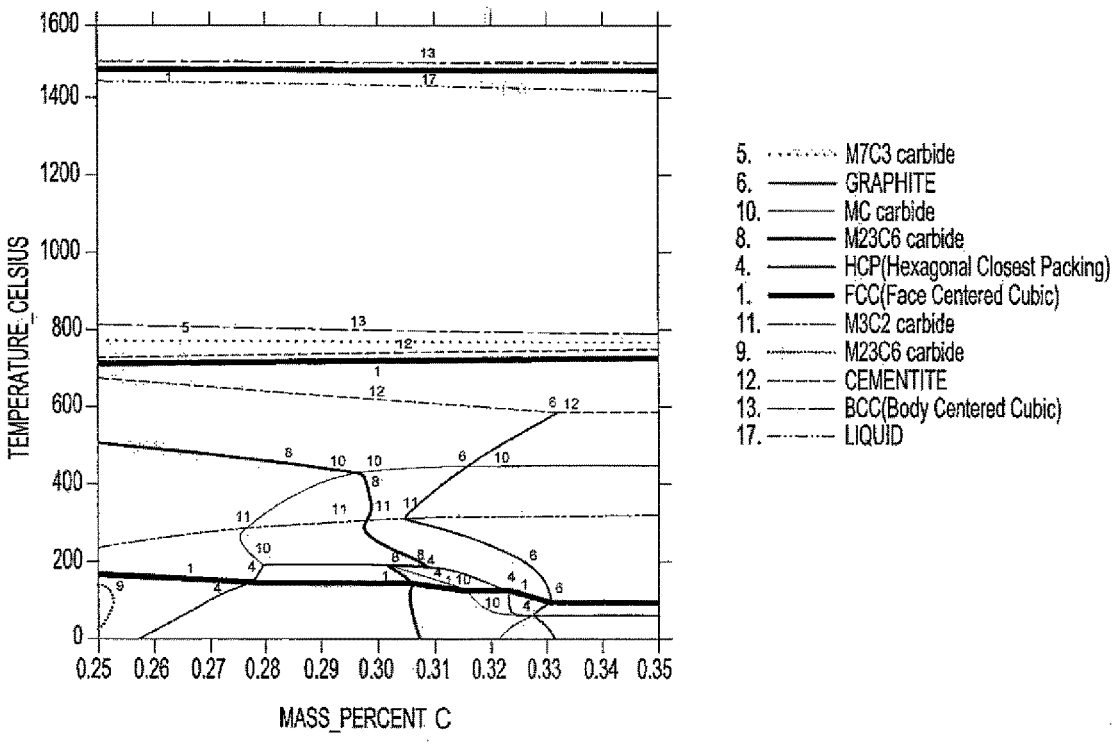
FIG. 1 illustrates a result of performing a ThermoCalc simulation of the part according to Example 1 of the present disclosure.

Hereinafter, the above-described present disclosure will be described in more detail.

1. Cast Steel for Construction Equipment Bucket Parts

A cast steel for construction equipment bucket parts of the present disclosure (hereinafter, referred to as 'cast steel') includes carbon, chromium, silicon, manganese, molybdenum and nickel in specific ranges, and thus shows high strength and has excellent abrasion resistance and durability. The cast steel will be specifically described as follows.

The cast steel of the present disclosure includes carbon (C) in an amount of 0.27 to 0.34 wt % based on the total weight. When the content of carbon is less than 0.27 wt %, the formation of carbide (particularly, MC carbide) in a structure thereof is reduced, so that abrasion resistance of the cast steel may deteriorate, and when the content is more than 0.34 wt %, strength (toughness) of the cast steel is reduced and tempering resistance deteriorates, so that abrasion resistance of the cast steel may deteriorate at high temperature. Therefore, carbon is included preferably within the range.

The cast steel of the present disclosure includes chromium (Cr) in an amount of 1.2 to 1.8 wt % based on the total weight. When the content of chromium is less than 1.2 wt %, the formation of carbide (particularly, MC carbide) in a structure thereof is reduced, so that abrasion resistance of the cast steel may deteriorate, and when the content is more than 1.8 wt %, $M_7C_3$ carbide is mainly formed rather than MC carbide due to an increase in content of chromium compared to the content of carbon, so that strength of the cast steel may be reduced. Therefore, chromium is included preferably within the range.

The cast steel of the present disclosure includes silicon (Si) in an amount of 0.8 to 1.7 wt % based on the total weight. When the content of silicon is less than 0.8 wt %, castability of the cast steel deteriorates, and when the content is more than 1.7 wt %, a compound (for example, $SiO_2$) responsible for generation of defects during casting may be formed and strength of the cast steel may be reduced. Therefore, silicon is included preferably within the range.

The cast steel of the present disclosure includes manganese (Mn) in an amount of 1.0 to 1.4 wt % based on the total weight. The manganese may serve as a deoxidizer, micronize perlite, and solid-solution strengthen ferrite, thereby enhancing yield strength of the cast steel. When the content of manganese is less than 1.0 wt %, viscosity of the cast steel may be reduced, and when the content is more than 1.4 wt %, crack or strain of the cast steel may be caused during quenching. Therefore, manganese is included preferably in the range.

The cast steel of the present disclosure includes molybdenum (Mo) in an amount of 0.2 to 0.4 wt % based on the total weight. When the content of molybdenum is less than 0.2 wt %, brittleness of the cast steel may be reduced, and when the content is more than 0.4 wt %, preparation costs of the cast steel may be increased. Therefore, molybdenum is included preferably in the range.

The cast steel of the present disclosure includes nickel (Ni) in an amount of 0.2 to 0.4 wt % based on the total weight. The nickel may micronize the structure of the cast steel and solid-solution strengthen austenite or ferrite, thereby enhancing yield strength of the cast steel. Further, when nickel is present together with chromium or molybdenum, hardening properties are enhanced, so that tempering may be easily performed during casting. The nickel is included preferably in the range in order to obtain a micronization effect of the structure and strength required.

The cast steel of the present disclosure includes iron (Fe) and impurities (for example, phosphorus (P), sulfur (S) and the like) as a balance in addition to the components.

The cast steel of the present disclosure includes carbide in a structure thereof, and the MC carbide (A) included in the carbide accounts for 10 to 65 vol %. That is, the cast steel of the present disclosure includes MC carbide (A) and at least one carbide (B) selected from the group consisting of $M_7C_3$ carbide, $M_3C_2$ carbide and $M_{23}C_6$ carbide in a structure thereof, and the MC carbide (A) is included in an amount of 10 to 65 vol % based on a total 100 vol % of the entire carbides (A+B). The M is a metalloid or transition metal component which may combine with carbon (C), and examples thereof include silicon (Si), chromium (Cr), molybdenum (Mo), vanadium (V) and the like.

In general, a skeleton of dendrite is formed in the structure of the cast steel according to the solidification rate during the preparation of the cast steel, and in this case, the metalloid or transition metal combines with carbon (C) depending on the site, thereby forming a carbide such as $M_7C_3$ carbide, $M_3C_2$ carbide, MC carbide or $M_{23}C_6$ carbide. Among them, MC carbide is observed in the crystal particles of the cast steel structure, and the other $M_7C_3$ carbide, $M_3C_2$ carbide and $M_{23}C_6$ carbide are observed at the boundary of the crystal particles of the cast steel structure. Herein, since crack or impact is usually transmitted along the boundary of the crystal particles, strength and durability of the cast steel may be increased when MC carbide observed in the crystal particles is formed rather than $M_7C_3$ carbide, $M_3C_2$ carbide and $M_{23}C_6$ carbide, which are observed at the boundary of the crystal particles.

Accordingly, the present disclosure may include carbon, chromium, silicon, manganese, molybdenum and nickel in specific ranges as described above to prepare a cast steel in which MC carbide in the structure accounts for 10 vol % or more based on the total 100 vol % of the entire carbides, thereby providing a cast steel showing high strength and having excellent durability and impact resistance.

Therefore, when parts for a construction equipment bucket are manufactured with the cast steel of the present disclosure and applied to a bucket, strength and durability of the bucket may be increased without any post-treatment processing (a tungsten carbide treatment such as KR20-1999-011857). Herein, in consideration of impact characteristics of the cast steel, it is preferred that the volume which MC carbide in the cast steel accounts for does not exceed 65 vol % based on the total 100 vol % of the entire carbides. Specifically, MC carbide is included more preferably in an amount of 15 to 45 vol % based on the total 100 vol % of the entire carbides.

Meanwhile, the volume of MC carbide present in the cast steel of the present disclosure may be measured by observing the cross-section of the cast steel by a microscope and performing a phase analysis on carbides (that is, $M_7C_3$ carbide, $M_3C_2$ carbide or $M_{23}C_6$ carbide) observed at the boundary of the crystal particles and carbide (that is, MC carbide) observed in the crystal particles by an image analyzer. The specific measurement method is as follows.

First, when the thickness (or length) of the cast steel begins from A1 and ends at A3, the cast steel is cut in a direction vertical to the ground at each point of $A_1$, $A_2$ and $A_3$. Next, each of the cut surfaces is image-analyzed, and the areas occupied by carbides observed at the boundary of the crystal particles (carbides present at the boundary of the crystal particles) and carbide observed in the crystal particles (carbide present in the crystal particles) are measured at each of the cut surfaces. Thereafter, the volume (V) of MC carbide included in the cast steel having a thickness from $A_1$ to $A_3$ may be calculated by the following equation.

$V$={(the area which carbide observed in the crystal particles occupies at the cut surface of $A_1$ point/the total area which carbide observed at the boundary of the crystal particles and carbide observed in the crystal particles occupy at the cut surface of $A_1$ point)+(the area which carbide observed in the crystal particles occupies at the cut surface of $A_2$ point/the total area which carbide observed at the boundary of the crystal particles and carbide observed in the crystal particles occupy at the cut surface of $A_2$ point)+(the area which carbide observed in the crystal particles occupies at the cut surface of $A_3$ point/the total area which carbide observed at the boundary of the crystal particles and carbide observed in the crystal particles occupy at the cut surface of $A_3$ point)}×3

As described above, the volume of MC carbide included in the cast steel of the present disclosure is 10 to 65 vol % based on the total 100 vol % of the entire carbides, and may be represented as 0.1 to 0.65 when the volume is applied as a ratio of the area.

Specifically, in the cast steel of the present disclosure, when a cut surface after cutting is analyzed by an image analyzer, a ratio (b/a) of an area (b) occupied by the MC carbide (carbide present in the crystal particles) to an area (a) occupied by the entire carbides (carbide present at the boundary of the crystal particles and carbide present in the crystal particles) is 0.1 to 0.65 at the cut surface.

Meanwhile, it is preferred that the cast steel of the present disclosure includes chromium, silicon and manganese in the ranges, in which the total content thereof (Cr+Si+Mn) is 4.1 to 4.9 wt %. When the total content of chromium, silicon and manganese included in the cast steel is less than 4.1 wt %, strength of the cast steel may be decreased. Specifically, when the total content of chromium, silicon and manganese is less than 4.1 wt %, MC carbide greatly affecting strength and durability of the cast steel may not be formed or may be formed in an amount less than 10 vol %, thereby making strength and durability of the cast steel may deteriorate. Therefore, it is preferred that the total content of chromium, silicon and manganese is 4.1 wt % or more, and in consideration of each content, it is preferred that the total content thereof does not exceed 4.9 wt %.

The cast steel of the present disclosure may include vanadium (V) in an amount of 0.01 to 0.03 wt % based on the total weight in order to enhance strength (toughness). The vanadium may form fine particle carbide to micronize the structure of the cast steel, thereby enhancing strength of the cast steel. The vanadium is included preferably in the range in order to obtain a micronization effect and strength required.

A method of preparing the cast steel of the present disclosure is not particularly limited, but a lost wax casting process, a shell mold process, a green sand casting process and the like may be used to manufacture the cast steel.

2. Parts for Construction Equipment Bucket

The present disclosure provides parts for a construction equipment bucket obtained by subjecting the cast steel to post-treatment. Specifically, the parts for a construction equipment bucket of the present disclosure may be manufactured by subjecting the cast steel to post-treatment such as tempering and/or quenching. The parts for a construction equipment bucket of the present disclosure are composed of the cast steel described above, and thus have a long life span and excellent durability and impact resistance.

The parts for a construction equipment bucket of the present disclosure are not particularly limited, but are preferably a tooth, a tooth adapter, a shroud or a cutter.

Specifically, the parts for a construction equipment bucket of the present disclosure may be a tooth showing a 47 to 52 HRC in core hardness and a 50 HRC in surface hardness, which is obtained by subjecting the cast steel to tempering in a range from 880° C. to 930° C., quenching in cooling water in a range from 40° C. to 80° C., and then again tempering in a range from 190° C. to 240° C.

The parts for a construction equipment bucket of the present disclosure may be a tooth adapter showing a 28 to 34 HRC in core hardness and a 30 to 40 HRC in surface hardness, which is obtained by subjecting the cast steel to tempering in a range from 880° C. to 930° C., quenching in cooling water in a range from 40° C. to 80° C., and then again tempering in a range from 480° C. to 530° C.

The parts for a construction equipment bucket of the present disclosure may be a shroud or cutter showing a 47 to 50 HRC in core hardness and a 48 to 53 HRC in surface hardness, which is obtained by subjecting the cast steel to tempering in a range from 880° C. to 930° C., quenching in cooling water in a range from 40° C. to 80° C., and then again tempering in a range from 190° C. to 240° C.

Hereinafter, the present disclosure will be specifically described through Examples, but the following Examples only illustrate one form of the present disclosure, and the scope of the present disclosure is not limited by the following Examples.

Examples 1 to 4 and Comparative Examples 1 to 5

A cast steel composed of components in the form of Y-block in the following Table 1 was prepared through a green sand casting process, subjected to primary tempering at 910° C. for 2 hours, and then quenched in cooling water at 50° C. Thereafter, each of the parts was manufactured by subjecting the cast steel to secondary tempering at 220° C. for 3 hours.

TABLE 1

| | Chemical Analysis, wt % | | | | | | | | | |
|---|---|---|---|---|---|---|---|---|---|---|
| Type | C | Si | Mn | P | S | Cr | Mo | Ni | Fe | Si + Mn + Cr |
| Example 1 | 0.30 | 1.52 | 1.01 | 0.015 | 0.009 | 1.61 | 0.28 | 0.25 | Balance | 4.14 |
| Example 2 | 0.34 | 1.3 | 1.3 | 0.023 | 0.012 | 1.52 | 0.25 | 0.21 | Balance | 4.12 |
| Example 3 | 0.29 | 1.40 | 1.21 | 0.023 | 0.012 | 1.51 | 0.27 | 0.22 | Balance | 4.12 |
| Example 4 | 0.33 | 1.52 | 1.39 | 0.015 | 0.008 | 1.78 | 0.27 | 0.29 | Balance | 4.69 |
| Comparative Example 1 | 0.28 | 1.69 | 1.31 | 0.018 | 0.012 | 1.11 | 0.29 | 0.23 | Balance | 4.11 |

TABLE 1-continued

| Type | Chemical Analysis, wt % | | | | | | | | | |
|---|---|---|---|---|---|---|---|---|---|---|
| | C | Si | Mn | P | S | Cr | Mo | Ni | Fe | Si + Mn + Cr |
| Comparative Example 2 | 0.25 | 1.30 | 1.17 | 0.022 | 0.007 | 1.63 | 0.23 | 0.01 | Balance | 4.10 |
| Comparative Example 3 | 0.32 | 1.2 | 0.96 | 0.025 | 0.003 | 0.9 | 0.21 | 0.01 | Balance | 3.06 |
| Comparative Example 4 | 0.29 | 0.81 | 1.00 | 0.020 | 0.010 | 1.53 | 0.24 | 0.11 | Balance | 3.34 |
| Comparative Example 5 | 0.33 | 1.78 | 1.35 | 0.018 | 0.010 | 1.75 | 0.23 | 0.25 | Balance | 4.88 |

Experimental Example 1

The part manufactured in Example 1 was subjected to ThermoCalc simulation, and the result is illustrated in FIG. 1. Referring to FIG. 1, it can be confirmed that MC carbide was formed in the part.

Experimental Example 2

Figure 2:
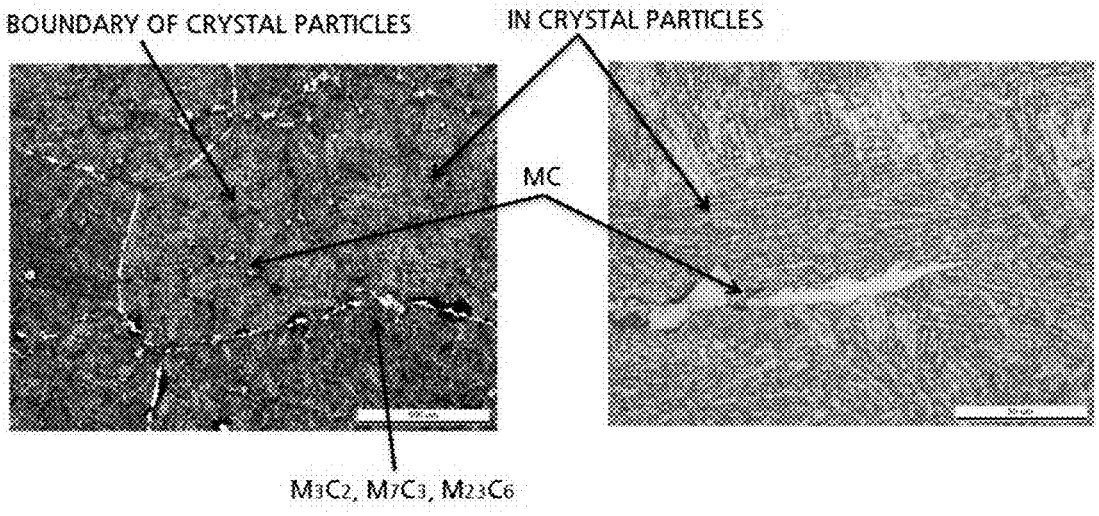
FIG. 2 illustrates a cross-section of the part according to Example 1 of the present disclosure.

The part manufactured in Example 1 was cut, and a specimen was mounted such that the cut surface was 2 cm×2 cm. Thereafter, after polishing and nital corrosion were performed, the cross section (the cut surface) was confirmed by a metal microscope, and the result is illustrated in FIG. 2. Referring to FIG. 2, it can be confirmed that MC carbide was formed in structure of the part.

Experimental Example 3

Physical properties of the parts manufactured in Examples 1 to 4 and Comparative Examples 1 to 5 were evaluated by the following method, and the results are shown in the following Table 2.

1. Surface hardness: measured by a Rockwell hardness tester (150 kg).
2. Abrasion amount of earth and sand: evaluated in accordance with the ASTM G65-85 (Standard Practice for Conducting Dry Sand/Runner Wheel Abrasion Tests).
3. Impact energy: measured using a Charpy impact tester. In this case, V notch was performed on an impact specimen.
4. Ratio (b/a) of an area (b) of MC carbide to an area (a) of carbide: after the part was cut vertically, the cut surface was observed by a metal microscope, a phase analysis was performed by an image analyzer manufactured by Leica, Inc., and then the ratio was calculated by the following equation.

*Ratio=area of MC carbide in the crystal particles found at the cut surface of the part/(area of carbide in the crystal particles found at the cut surface of the part+area of carbide at the boundary of crystal particles found at the cut surface of the part)

TABLE 2

| | Surface hardness (HRC) | Abrasion amount of earth and sand ($mm^3$) | Impact energy (toughness) (Joule, −40° C.) | Ratio (b/a) |
|---|---|---|---|---|
| Example 1 | 51.0 | 162.0 | 26.5 | 0.21 |
| Example 2 | 52.1 | 161.4 | 24.0 | 0.19 |
| Example 3 | 50.9 | 171.9 | 24.9 | 0.1 |

TABLE 2-continued

| | Surface hardness (HRC) | Abrasion amount of earth and sand ($mm^3$) | Impact energy (toughness) (Joule, −40° C.) | Ratio (b/a) |
|---|---|---|---|---|
| Example 4 | 51.5 | 158.3 | 15.9 | 0.65 |
| Comparative Example 1 | 48.7 | 198.6 | 11.5 | 0.08 |
| Comparative Example 2 | 47.0 | 212.2 | 10.5 | 0.03 |
| Comparative Example 3 | 44.4 | 312.2 | 7.5 | 0 |
| Comparative Example 4 | 45.2 | 297.2 | 11.0 | 0.05 |
| Comparative Example 5 | 51.7 | 162.1 | 2.8 | 0.77 |

Referring to Table 2, it can be confirmed that the parts according to the present disclosure (Examples 1 to 4) have high strength and are excellent in durability and abrasion resistance.

Meanwhile, it can be confirmed that abrasion resistance deteriorates due to insufficient content of Cr in Comparative Example 1, and durability and strength deteriorate due to insufficient content of C in Comparative Example 2. Further, it can be confirmed in Comparative Example 3 that durability and strength deteriorate due to insufficient content of Si+Mn+Cr and insufficient content of Mn, and in Comparative Example 4 that durability and strength deteriorate due to insufficient content of Si+Mn+Cr and insufficient content of Ni. In addition, it can be confirmed in Comparative Example 5 that as the content of Si exceeds, impact characteristics significantly deteriorate.

Example 5 and Comparative Example 6

The cast steel composed of the composition in Example 1 and Comparative Example 4 and in the form of a tooth was subjected to primary tempering at 910° C. for 2 hours, and then quenched in cooling water at 50° C. Thereafter, each of the tooth was manufactured by subjecting the cast steel to secondary tempering at 220° C. for 3 hours.

[Experimental Example 4] Evaluation of Abrasion Performance

Figure 3:
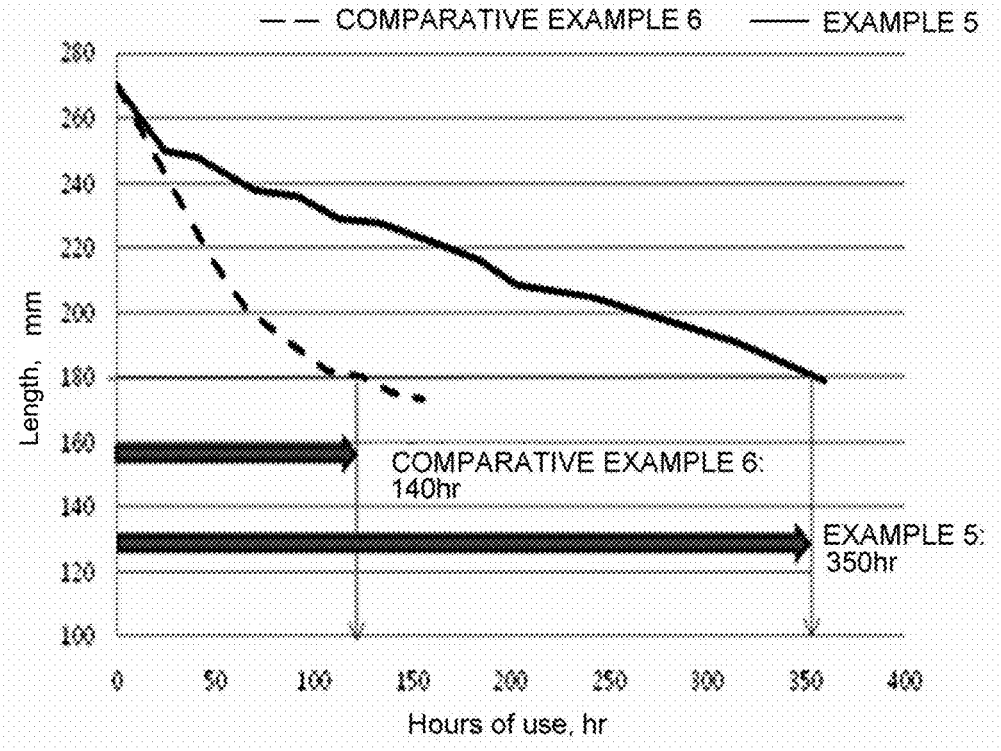
FIG. 3 illustrates an evaluation of the life span of the tooth according to Example 5 and Comparative Example 6 of the present disclosure.

After the tooth manufactured in Example 5 and Comparative Example 6 were coupled to a bucket of an excavator, a change in length of the tooth over time was measured by using the excavator at a road construction site, and the result is illustrated in FIG. 3.

Referring to FIG. 3, it can be confirmed that the life span of the tooth in Example 5 was enhanced by two times or more than that of the tooth in Comparative Example 6.

What is claimed is:

1. A cast steel for use with a construction equipment bucket part, comprising greater than 0.30 and less than or equal to 0.34 wt % of carbon (C), 1.2 to 1.8 wt % of chromium (Cr), 0.8 to 1.7 wt % of silicon (Si), 1.0 to 1.4 wt % of manganese (Mn), 0.2 to 0.4 wt % of molybdenum (Mo), 0.2 to 0.4 wt % of nickel (Ni), and a balance of iron and impurities, and comprising MC carbide and at least one carbide selected from $M_7C_3$ carbide, $M_3C_2$ carbide and $M_{23}C_6$ carbide in a structure thereof, wherein the MC carbide is comprised in an amount of 15 to 45 vol % based on a total 100 vol % of the entire carbides.

2. The cast steel of claim 1, wherein the MC carbide is comprised in crystal particles of the cast steel, and at least one carbide selected from the $M_7C_3$ carbide, the $M_3C_2$ carbide and the $M_{23}C_6$ carbide is comprised at a boundary of the crystal particles of the cast steel.

3. The cast steel of claim 1, wherein a total content of the chromium (Cr), silicon (Si) and manganese (Mn) is 4.1 to 4.9 wt %.

4. The cast steel of claim 1, further comprising 0.01 to 0.03 wt % of vanadium (V).

5. A part for use with a construction equipment bucket obtained by subjecting the cast steel of claim 1 to post-treatment.

6. The part of claim 5, wherein the part is a tooth, a tooth adapter, a shroud or a cutter.

7. The part of claim 5, wherein the MC carbide is comprised in crystal particles of the cast steel, and at least one carbide selected from the $M_7C_3$ carbide, the $M_3C_2$ carbide and the $M_{23}C_6$ carbide is comprised at a boundary of the crystal particles of the cast steel.

8. The part of claim 5, wherein a total content of the chromium (Cr), silicon (Si) and manganese (Mn) is 4.1 to 4.9 wt %.

9. The part of claim 5, further comprising 0.01 to 0.03 wt % of vanadium (V).

10. A cast steel for use with a construction equipment bucket part, comprising greater than 0.30 and less than or equal to 0.34 wt % of carbon (C), 1.2 to 1.8 wt % of chromium (Cr), 0.8 to 1.7 wt % of silicon (Si), 1.0 to 1.4 wt % of manganese (Mn), 0.2 to 0.4 wt % of molybdenum (Mo), 0.2 to 0.4 wt % of nickel (Ni), and a balance of iron and impurities, and comprising MC carbide and at least one carbide selected from $M_7C_3$ carbide, $M_3C_2$ carbide and $M_{23}C_6$ carbide in a structure thereof, wherein when a cut surface after cutting of the cast steel is analyzed by an image analyzer, a ratio (b/a) of an area (b) of the MC carbide to an area (a) of the entire carbide is 0.1 to 0.65 at the cut surface, and wherein the MC carbide is comprised in crystal particles of the cast steel, and at least one carbide selected from the $M_7C_3$ carbide, the $M_3C_2$ carbide and the $M_{23}C_6$ carbide is comprised at a boundary of the crystal particles of the cast steel.

11. A part for use with a construction equipment bucket obtained by subjecting the cast steel of claim 10 to post-treatment.

12. The part of claim 11, wherein the part is a tooth, a tooth adapter, a shroud or a cutter.

* * * * *